US012721412B2

(12) United States Patent
Denoon

(10) Patent No.: US 12,721,412 B2
(45) Date of Patent: Sep. 1, 2026

(54) BRAIDING TRAINING TOOL

(71) Applicant: Emalia Denoon, Baltimore, MD (US)

(72) Inventor: Emalia Denoon, Baltimore, MD (US)

( * ) Notice: Subject to any disclaimer, the term of this patent is extended or adjusted under 35 U.S.C. 154(b) by 164 days.

(21) Appl. No.: 18/405,020

(22) Filed: Jan. 5, 2024

(65) Prior Publication Data

US 2024/0130503 A1 Apr. 25, 2024

Related U.S. Application Data

(60) Continuation-in-part of application No. 17/931,211, filed on Sep. 12, 2022, now Pat. No. 12,004,622, which is a division of application No. 17/301,587, filed on Apr. 8, 2021, now Pat. No. 11,464,310, which is a continuation-in-part of application No. 15/929,545, filed on May 8, 2020, now abandoned, which is a continuation of application No. 15/606,722, filed on May 26, 2017, now Pat. No. 10,653,223.

(51) Int. Cl.

| | |
|---|---|
| ***G09B 19/00*** | (2006.01) |
| ***A45D 2/00*** | (2006.01) |
| ***A45D 8/00*** | (2006.01) |
| ***A45D 8/34*** | (2006.01) |

(52) U.S. Cl.

CPC ..... *A45D 2/00* (2013.01); *A45D 8/00* (2013.01); *A45D 8/34* (2013.01); *A45D 2002/003* (2013.01); *A45D 2002/005* (2013.01); *A45D 8/002* (2021.01)

(58) Field of Classification Search

CPC .... G09B 19/00; G09B 19/0076; A45D 44/14; A63H 3/44

USPC ..... 434/94

See application file for complete search history.

(56) References Cited

U.S. PATENT DOCUMENTS

| | | | | |
|---|---|---|---|---|
| 2,165,476 A * | 7/1939 | Greneker | ..... | A47F 8/00 434/94 |
| 3,808,736 A * | 5/1974 | Terzian | ..... | A45D 44/14 446/296 |
| 3,930,331 A | 1/1976 | Simeone | | |
| 4,017,984 A | 4/1977 | Bonfigli | | |
| 4,193,615 A * | 3/1980 | Memmott | ..... | B42D 15/00 434/94 |
| 4,370,137 A * | 1/1983 | Herzig | ..... | A45D 44/14 434/94 |
| 4,403,962 A * | 9/1983 | La Vista | ..... | G09B 25/00 434/94 |

(Continued)

OTHER PUBLICATIONS

Horizon Group USA, "Just My Style Braid-tastic Braiding and Beading Workstation," Oct. 27, 2016, horizongroupusa.com, at https://web.archive.org/web/20161027052144/https://www.horizongroupusa.com/tweens/braid-tastic (last visited Dec. 29, 2023). Year:2016).

*Primary Examiner* — Kurt Fernstrom
(74) *Attorney, Agent, or Firm* — Dunlap Bennett & Ludwig PLLC; Anna L. Kinney

(57) ABSTRACT

A braid training tool includes a head component having multiple strands selected from human hair, synthetic hair, and/or yarn extending from a surface and partitioned into sectors. A method of strengthening dexterity with the tool includes separating the multiple strands in at least one of the sectors into a predetermined number of sections; interweaving the sections according to a predetermined pattern to form a braid having a selected length; and securing the braid.

13 Claims, 10 Drawing Sheets

(56) References Cited

U.S. PATENT DOCUMENTS 4,764,119 A * 8/1988 Miraglia ..... G09B 19/003 24/712
4,815,745 A 3/1989 Alvarez, Jr.
5,252,074 A * 10/1993 Passage ..... G09B 19/0076 434/94
D357,701 S * 4/1995 White ..... D21/659
5,590,668 A 1/1997 Macy
5,896,863 A 4/1999 Smith
7,164,347 B2 * 1/2007 Nita ..... G09B 23/00 434/270
7,410,358 B2 * 8/2008 Morehead ..... A63H 3/365 434/94
8,226,413 B2 * 7/2012 Yip ..... A45D 44/14 434/94
8,262,392 B2 * 9/2012 Kubo ..... G09B 19/00 434/94
8,496,481 B2 * 7/2013 Li ..... G09B 19/0076 434/94
8,555,898 B1 10/2013 Byrd
10,755,603 B1 * 8/2020 Truong ..... A41G 3/0083
11,533,981 B1 * 12/2022 Amis ..... A45D 44/14
2006/0008780 A1 * 1/2006 Pang ..... G09B 19/00 434/94
2006/0141900 A1 * 6/2006 Wesley ..... A63H 3/44 446/394
2007/0102881 A1 5/2007 Holden et al.
2010/0330869 A1 * 12/2010 Jung ..... A63H 3/44 446/319
2013/0230828 A1 * 9/2013 Pang ..... G09B 19/0076 434/94
2013/0244213 A1 * 9/2013 Davis ..... G09B 19/0076 434/260
2015/0072317 A1 * 3/2015 Dana ..... A45C 5/005 434/100
2015/0118654 A1 * 4/2015 Phillips ..... A45D 44/14 434/94
2023/0041853 A1 * 2/2023 Micaela Mallory ..... A45D 8/34

* cited by examiner

| | | | |
|---|---|---|---|
| ROW 1 START | 1 | 2 | 3 |
| ROW 2 | | | |
| ROW 3 | | | |
| ROW 4 | | | |
| ROW 5 | | | |
| ROW 6 | | | |
| ROW 7 | | | |
| | | PICK UP A FRIEND | |
| ROW 8 | | | |
| | | PICK UP A FRIEND | |
| ROW 9 | | | |
| | | PICK UP A FRIEND | |
| ROW 10 | | | |
| | | 2 | |
| ROW 11 | | | |
| | | 1 | |
| ROW 12 | | | |
| | | 3 | |
| ROW 13 | | | |

FIG.12D

BRAIDING TRAINING TOOL

CROSS-REFERENCE TO RELATED APPLICATION

This application is a division of application Ser. No. 17/301,587. Application Ser. No. 17/301,587 is a continuation-in-part of U.S. application Ser. No. 15/929,545, filed May 8, 2020, which is a continuation of U.S. application Ser. No. 15/606,722, filed May 26, 2017. The priorities of application Ser. Nos. 17/301,587, 15/929,545, and 15/606,722 are hereby claimed and the contents thereof are herein incorporated by reference.

BACKGROUND OF THE INVENTION

The present invention relates to learning how to braid hair and, more particularly, to a hair braiding kit, a braiding game, and a multi-ethnic pre-pluck mannequin.

A braid is a complex structure or pattern formed by interlacing three or more strands of flexible material such as textile yarns, wire, or hair. Currently, hair braiding is taught on a mannequin head or a human being, both of which include a curved surface. The curved head makes learning how to braid difficult and time consuming.

As can be seen, there is a need for a flat surfaced hair braiding kit to teach students how to master braiding before moving to braiding on a curved surface or head.

SUMMARY OF THE INVENTION

The present invention is believed to develop hair braiding skills such that the student can identify the key fingers used to braid, spot the characteristics of a well-executed braid, and self-correct when demonstrating braiding.

In one aspect of the present invention, a braid training tool comprises a head component having a plurality of strands extending from a surface thereof, wherein the plurality of strands is selected from the group consisting of: human hair, synthetic hair, yarn, and any combination thereof; and wherein the strands are partitioned into one or more sectors.

In another aspect of the present invention, a method of strengthening dexterity comprises providing the braid training tool; separating the plurality of strands in at least one of the one or more sectors into a predetermined number of sections; interweaving the sections according to a predetermined pattern to form a braid having a selected length; and securing the braid.

In aspects of the present invention, the plurality of strands may be formed into more than one braid selected from the group consisting of a cornrow, a plait, and combinations thereof; at least two sectors may be provided, each having a distinct thickness and/or texture; the sectors may be quadrants; the head component may further comprise a vertical surface with a face formed thereon; the head component may be configured as a mannequin head or may be configured as a container having a geometric shape selected from the group consisting of a cuboid, a cylinder, a cone, and a pyramid; the container may have at least one edge operative as a ruler; and/or the plurality of strands may have a first length operative to form a braid having a second length greater than the height of the container.

These and other features, aspects and advantages of the present invention will become better understood with reference to the following drawings, description, and claims.

BRIEF DESCRIPTION OF THE DRAWINGS

FIG. 12D is a schematic view of a game according to another embodiment of the present invention;

DETAILED DESCRIPTION OF THE INVENTION

Figure 1:
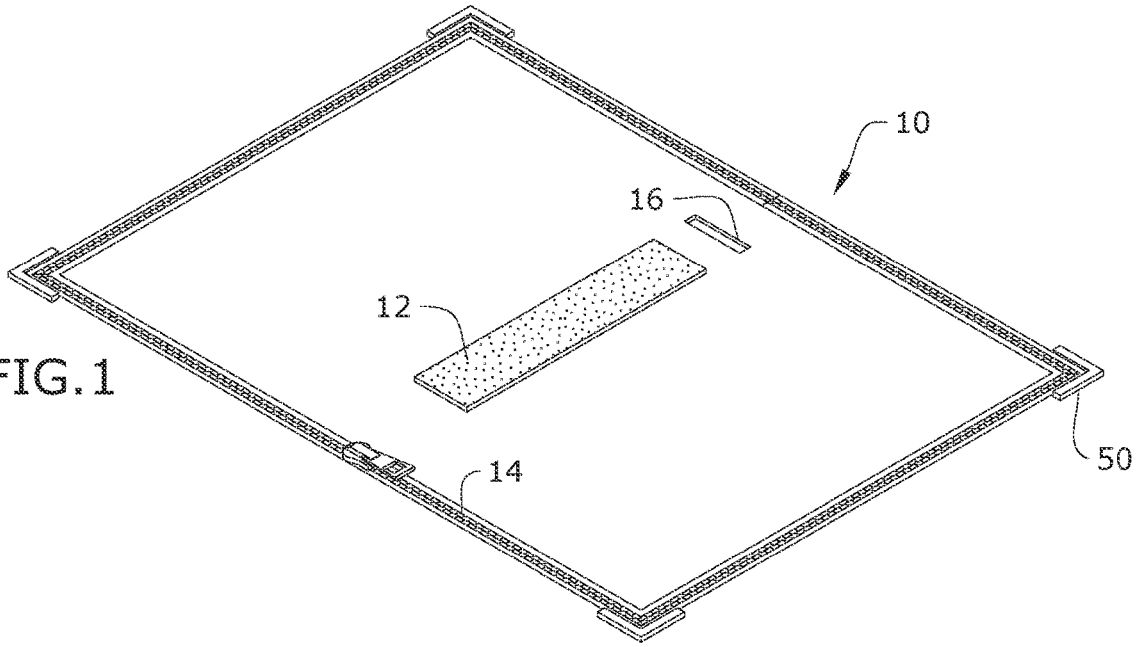
FIG. 1 is a perspective view of a mat component of a hair braiding kit according to an embodiment of the present invention.
Figure 2:
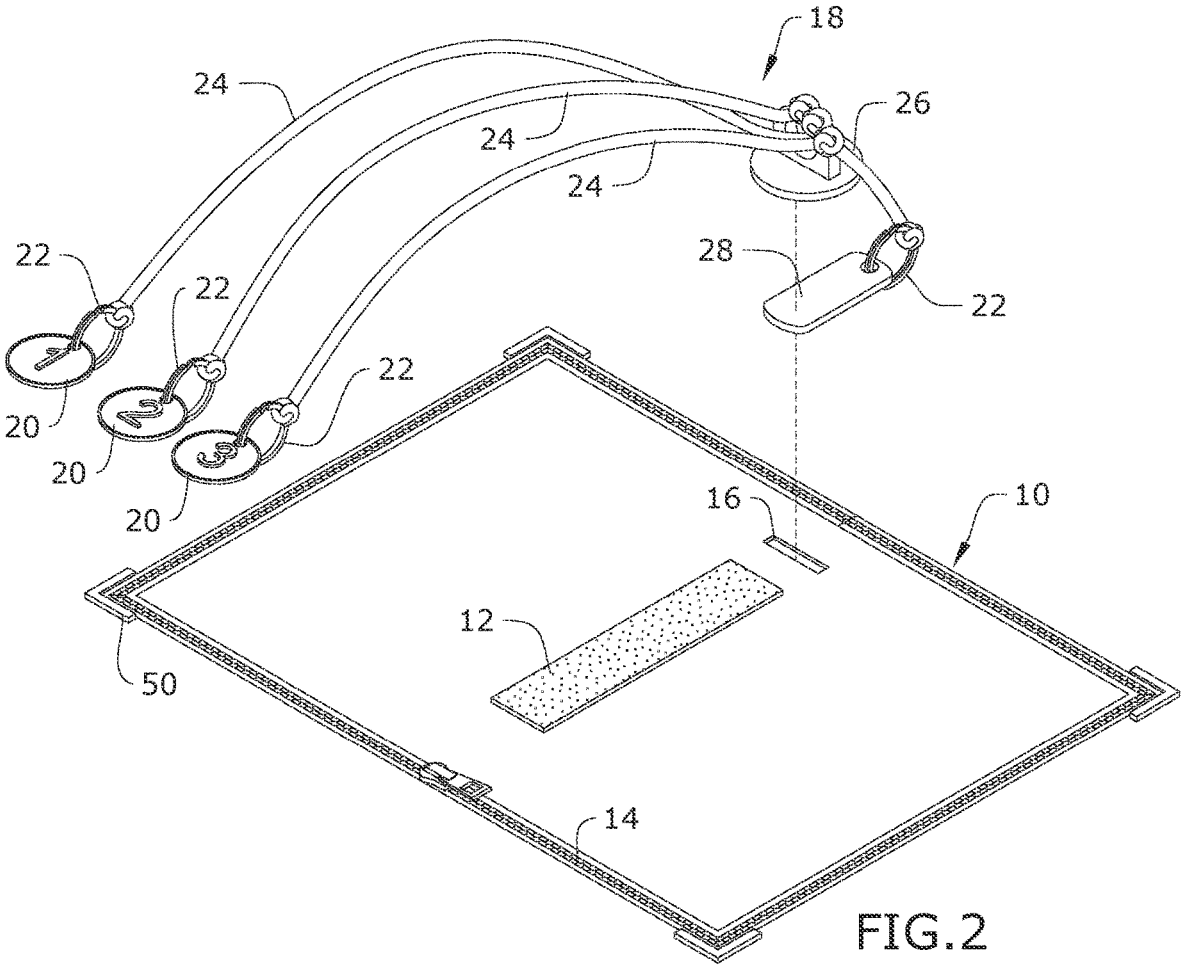
FIG. 2 is an exploded view of the hair braiding kit, showing the mat and a first hair attachment.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a flat surfaced hair braiding kit accompanied by teaching techniques specific to the hair braiding kit design. The present invention makes learning the art of braiding while mastering the techniques of finger placement and coordination easier and faster. An added benefit is that the braiding kit teaches users how to keep hands close to the foundation base without creating excess tension from pulling on a flat surface before proceeding to a curved head. The hair braiding kit allows users to learn to braid with or without extensions and apply the techniques learned to create inverted and French plaits (individual braids) and cornrows.

As used herein, the term "pre-pluck" refers to a substrate having hair or a hair analog pre-sectioned. For new braiders, learning to part a full head of hair while also learning to braid simultaneously can be challenging. Pre-sectioned hair allows the new braider to find parts easier by tracing along the pre-sectioned path while focusing on the skill of braiding.

As used herein, the term "multi-ethnic" refers to the presence of multiple hair types or analogs thereof, associated with multiple ethnicities, on a single mannequin. Each type of natural and/or synthetic hair may be present on a distinct section of the mannequin head, wherein the mannequin head has at least two sections. For example, the mannequin head may have four quadrants, with each quadrant having hair with a distinct thickness and/or texture.

The types of natural and/or synthetic hair or hair analog are not particularly limited. The strands may be fine, medium, or thick, or a mixture thereof. The hair may be straight, wavy, curly, and/or kinky. The strands may include a variety of thicknesses and textures, such as acrylic yarn; kinky, coarse hair; straight, fine hair; and medium, wavy hair.

In some embodiments, the braiding kit may have 2 platforms stitched in place to a single mat. Each platform comprises 3 columns of yarn, enabling a student to learn plaiting and cornrowing using 1-, 2- and 3-strand techniques, making the training platform more versatile. The yarns are generally U-shaped along the stitch pleat. In some cases, yarn color may serve as a unique identifier. A first "basic" platform may comprise 3 columns of yarn, e.g., within a weight category of about 6 to about 7, in 3 colors (e.g., blue, yellow, and red), each column having about 12 to about 16 strands of each color of yarn. The basic platform may be used to teach fundamentals of plaiting and cornrow. A second "advanced" platform may comprise 3 columns of thinner yarn, e.g., within a yarn weight category of about 4 to about 5, with about 66 to about 150 strands. The "advanced" strands may be randomly provided in assorted colors across all columns. The yarn strands of the advanced platform may reinforce the fundamentals of plaiting and cornrow learned on the basic platform. A jingle may be provided to assist students in learning where each finger goes.

The materials of manufacture are not particularly limited. While the term "yarn" is referred to throughout, any suitable hair strands or analog thereof may be used. In some embodiments, multiple types of yarn may be used. For example, different weights of yarn ranging, for example, from a yarn weight category of about 4 to a yarn category of about 7 may be provided in a single kit. The base mat of the present invention may be made of plastic, flexible woven or biodegradable material, for example.

The mat may include a connector that may releasably retain an attachment, such as a Velcro® fastener, clips, snaps, buckles, hook and fastener and the like.

In some embodiments, the yarn or hair sample may be laced through a net backing such that both ends of the hair sample extend from the same side of the net backing and are secured in place with an adhesive substrate such as a sticker. The assembled net and adhesive substrate holding one or more hair samples may be used directly as a braiding kit or may be attached to a braiding kit mat. Multiple thicknesses, textures, etc. of sample hair and/or yarn may be added to the assembly.

In some embodiments, a game (also referred to herein as "the effortless braid game") is provided to teach plaiting and cornrowing cognitively through pattern identification, sequence recognition, psycho-motor coordination, and testing. The game may be played by writing the answers, e.g., on paper, or by using a set of pawns or other pawn-like game pieces. The game pieces may be provided in 3 different colors (e.g., blue, yellow, red) to serve as unique identifiers. Alternatively, numbered game pieces may be used (e.g., 1, 2, 3). Students may work individually, in groups, or in pairs, as determined by a roll of dice. Students may predict the number that will result. In the event a determination cannot be made, a coin toss will determine the result. A stopwatch may be provided.

The game may be played on a board having a grid comprising about 7 rows and about 3-4 columns, or "lanes", forming multiple grid cells. The number of game pieces matches the number of gameplay cells. For example, a grid having 3 lanes (not including a row label column) and 7 rows has 21 gameplay cells, so 21 game pieces are provided for play. At the end of successful gameplay, every game piece may be placed on the board. In some embodiments, at least 4 finger placement images relating to the braiding technique being taught may be provided in the grid cells. The grid may be selected based on the type of braid being simulated and the skill level of the student. A "basic" grid with 4 columns, row labels, and 3 individually colored game pieces may be used to learn plaits. An "intermediate" grid with 3 columns and a column of row numbers (e.g., 1,2,3) may also be used with 3 game pieces in a single solid color, or with numbers, to learn plaits. An "advanced" grid may be used to learn cornrows. The advanced grid combines a "basic" grid with an additional 6 rows interspersed with hints to add a game piece or other marker that matches the game piece in the center column of the immediately preceding row. The hints may be labeled "Pick up a friend" and/or "1", "2", "3", for example. The hint cells may, in some cases, have color to aid the players. The hints are symbolic of periodically adding additional strands of yarn or hair to a plait to form a cornrow. The game pieces from the "basic" grid may be moved down as the players proceed through the "advanced" grid. Alternatively, all the game pieces may be removed from the basic grid for use on the advanced grid. In some cases, the board may be folded so that a basic grid or an advanced grid appears alone unless the board is unfolded to also exhibit both grids. In other cases, the board may have a basic grid on one surface and an advanced grid on an opposite surface and may be turned over to continue gameplay.

In some embodiments, the pawn movements may be determined based on the column in which they start. A pawn in "lane" 1 or 3 may either move one straight down or diagonally to the middle "lane". A pawn in "lane" 2 may not move straight down. Rather, it moves diagonally. Once a pawn has moved straight down once, it may not move straight down again. Rather, it moves diagonally. In other embodiments, game pieces may be added to represent the "move". In that case, at the end of play, all game pieces are present on the board.

In some embodiments, a pre-pluck multi-ethnic mannequin is provided, enabling students to practice parting cornrows by braiding each mannequin's hair in a complete hairstyle, such as Cornrow updo, Reverse Cornrow updo, Cornrows straight back, Cornrow and plait combo, and Plait hairstyles. The mannequin's gender may vary. In some cases, the mannequin may be non-gendered and faceless, with the entire surface of the mannequin head covered with varying textures of hair to build dexterity, competence, and confidence. The mannequin may be pre-sectioned, varying between small and extra-large sections, with a number of strands sufficient for production of between 1 to about 250 cornrows and between 1 to about 1500 plaits.

In an embodiment of the present invention, a training method is provided, combining the inventive braiding kit and/or the inventive game with the inventive pre-sectioned/pre-plucked mannequin, arranged communally into easy cornrow and plait hairstyles. Each section may have a different scrunchie for students to identify their cornrow and plait.

Referring to FIGS. 1-16, FIG. 1 illustrates a hair braiding kit of the present invention. The hair braiding kit includes a base mat 10 and at least a first hair attachment 18. The base mat 10 includes an upper surface, a lower surface, and an outer edge. The first hair attachment 18 includes a first support 26 protruding from the upper surface of the base mat 10. The first hair attachment 18 further includes a plurality of strands 24 each having a first end, a second end and a unique identifier 20. The first end of each of the strands 24 is attached to the first support 26.

In certain embodiments, a zipper 14 may be disposed along the outer edge of the base mat 10. Therefore, the base mat 10 may act as a purse and may store all the attachments 18, 32, 40, 44 within. When a user is ready to practice braiding, the zipper 14 may be unzipped and the base mat 10 may lay flat on a surface. A weight 50 may be secured to each corner of the base mat 10 to further stabilize the base mat 10 on the surface. The base mat 10 may further include a connector, such as a Velcro® fastener 12, attached to the upper surface.

In certain embodiments, the first support 26 may include a horizontal and a vertical portion extending from the horizontal portion. In such embodiments, the base mat 10 may include a slit 16 formed through the upper and lower surface. The vertical portion fits through the slit 16 and protrudes upward from the upper surface of the base mat 10. A flat piece 28 may be secured to the horizontal portion of the first support 26 by a strand and a ring 22. When in use, the flat piece 28 may be taped down to the support and prevent the first support 26 from being pulled through the slit 16.

Figure 3:
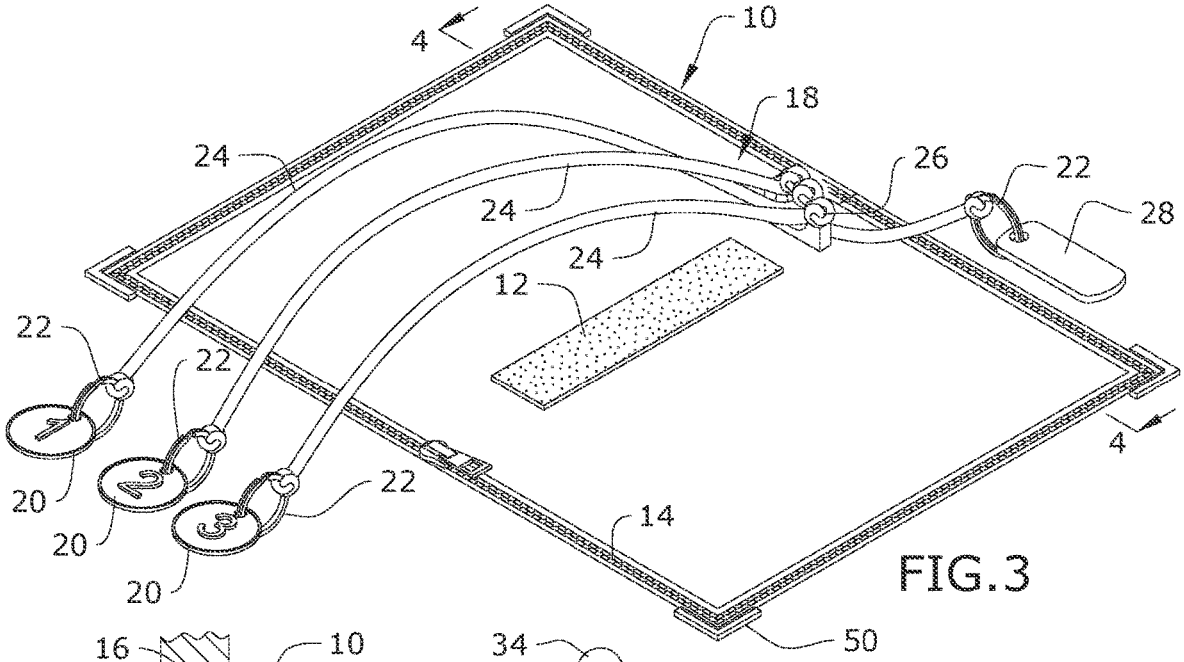
FIG. 3 is a perspective view thereof.
Figure 4:
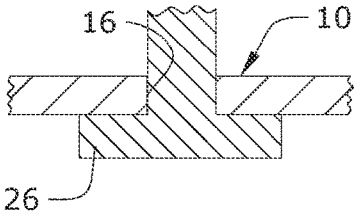
FIG. 4 is a sectional detail view thereof, taken along line 4-4 in FIG. 3.
Figure 5:
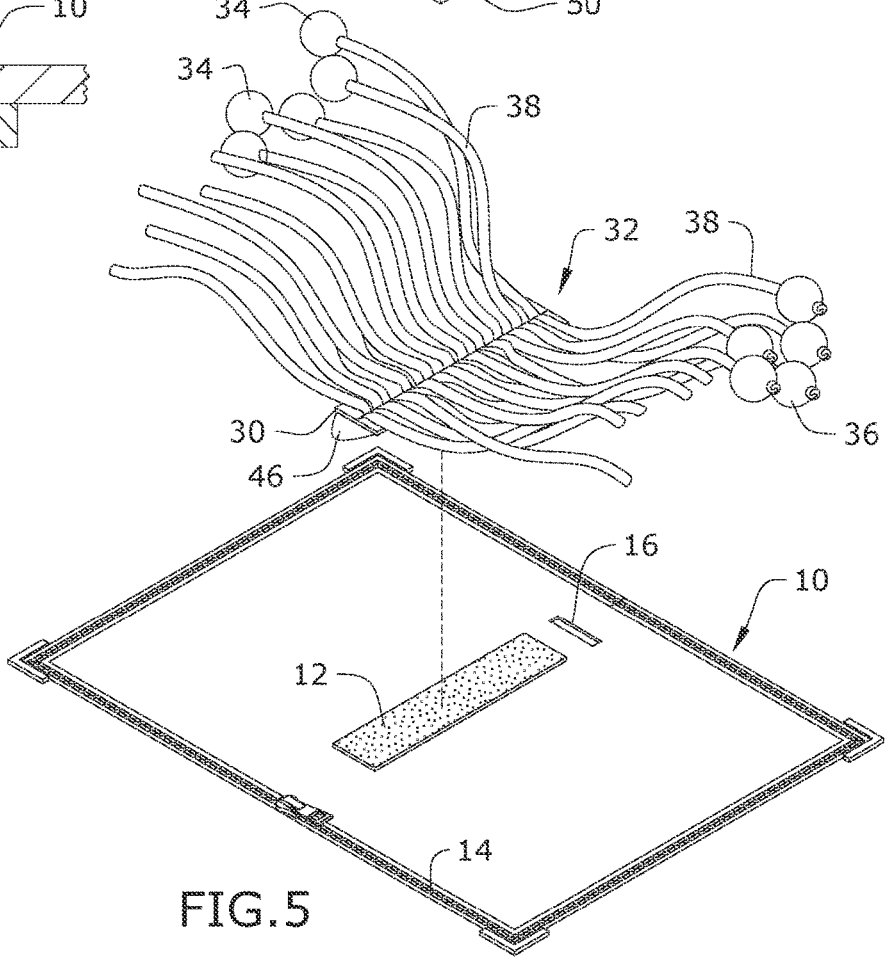
FIG. 5 is an exploded view of the hair braiding kit, showing the mat and a second hair attachment.
Figure 6:
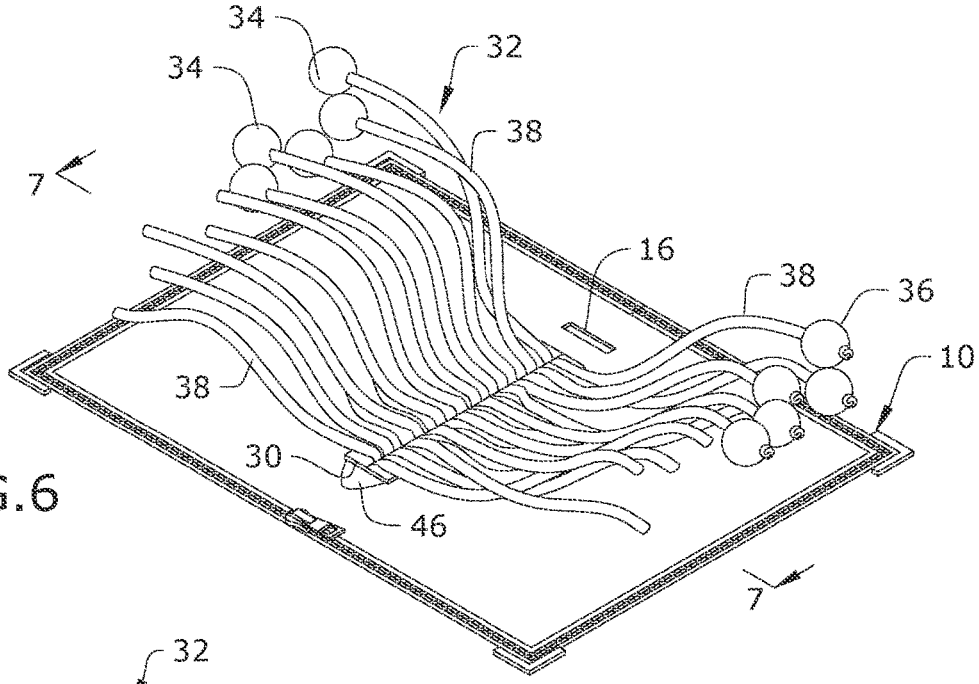
FIG. 6 is a perspective view thereof.
Figure 7:
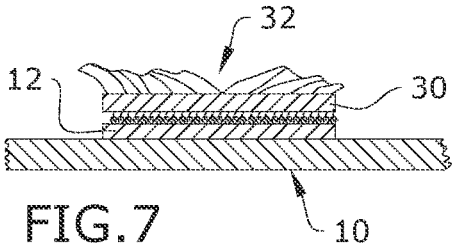
FIG. 7 is a sectional detail view thereof, taken along line 7-7 in FIG. 6.
Figure 8:
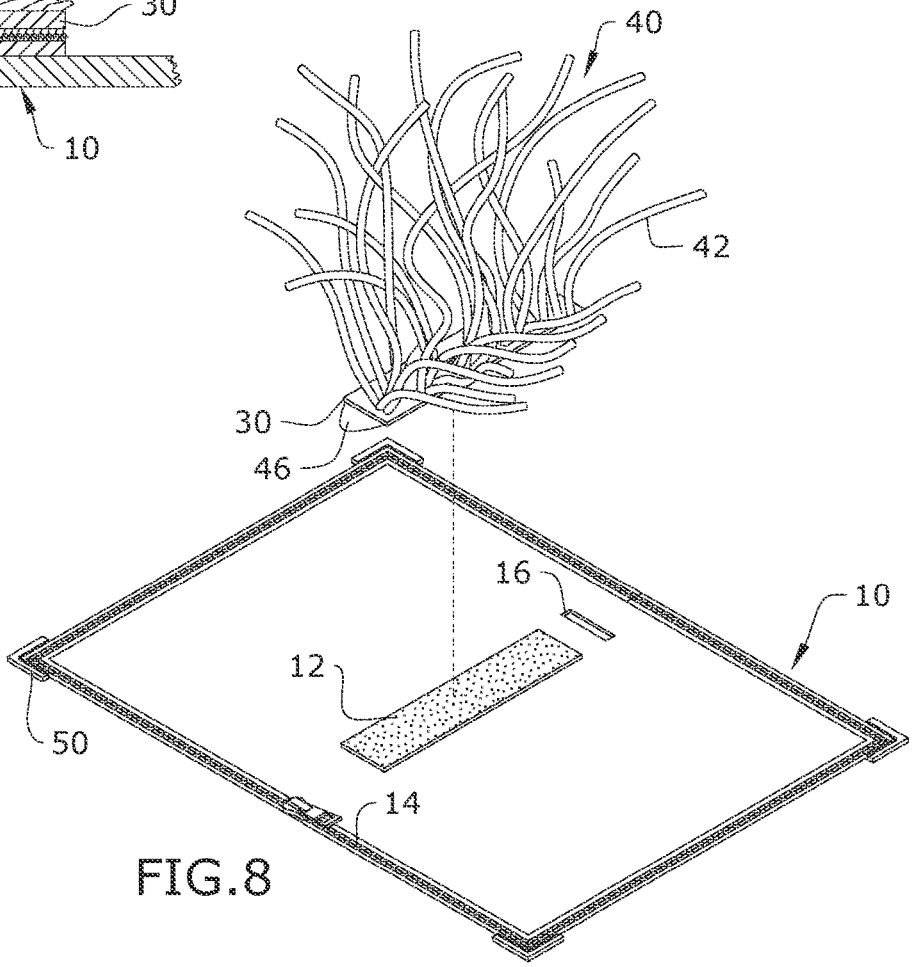
FIG. 8 is an exploded view of the hair braiding kit, showing the mat and a third hair attachment.
Figure 9:
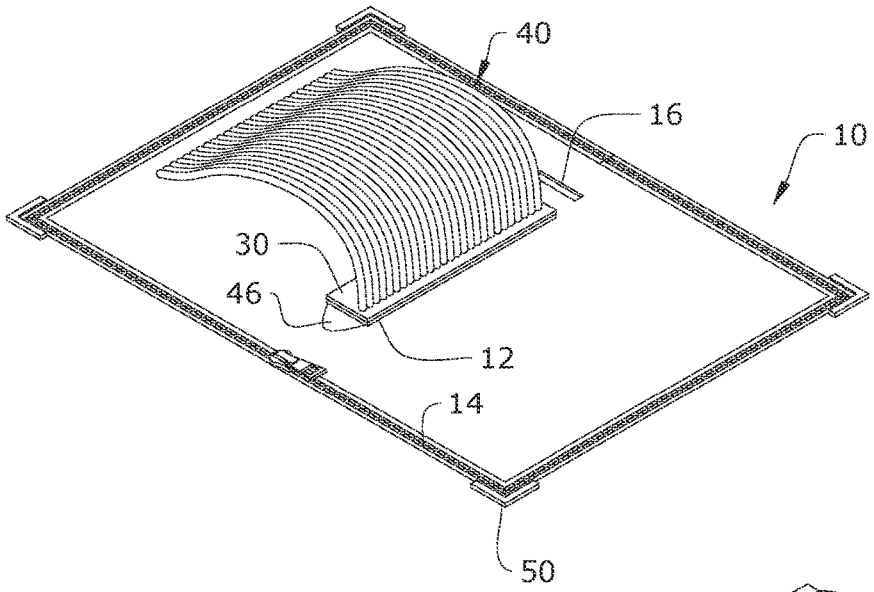
FIG. 9 is a perspective view thereof.
Figure 10:
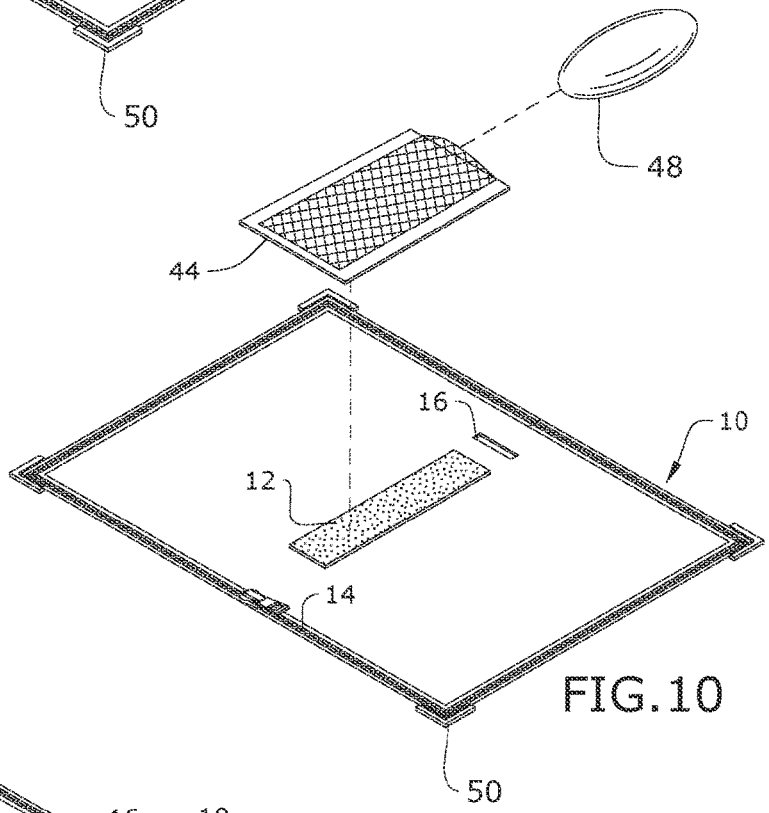
FIG. 10 is an exploded view of the hair braiding kit, showing the mat and a fourth attachment.
Figure 11:
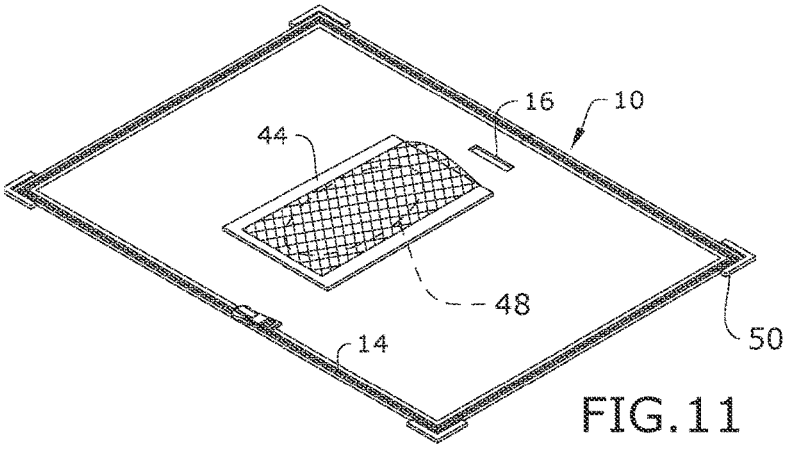
FIG. 11 is a perspective view thereof.

The plurality of strands 24 may include a first strand, a second strand and a third strand. The unique identifier 20 is at least one sequential indicator such as a printed number or letter and a color. As illustrated in FIG. 3, the unique identifier is the printed number or letter. A first tag having a first number is secured to the second end of the first strand 24 by a ring 22. A second tag having a second number is secured to the second end of the second strand 24 by a ring 22. A third tag having a third number is secured to the second end of the third strand 24 by a ring 22. Therefore, an instructor may indicate the color and number of the strand 24 to use and the user may quickly find the strand 24 while learning how to braid.

The present invention may further include a second hair attachment 32. The second hair attachment 32 includes a strip 30 having another Velcro® fastener. A plurality of strands 38 are attached to the strip 30. The plurality of strands 38 include a first set of strands 38 disposed on one side of the strip 30 and a second set of strands 38 disposed on the other side of the strip 30. A plurality of first colored beads 34 are secured to each of the strands 38 of the first set and a plurality of second colored beads 36 are secured to each of the strands 38 of the second set.

The present invention may further include a third hair attachment 40. The third hair attachment 40 includes a strip 30 including another Velcro® fastener, and a plurality of strands 42 attached to the strip 30.

The second and third hair attachments 38, 40 releasably attach to the Velcro® fastener 12 of the base mat 10. A user may practice forming corn rows using the second 32 and third attachments 40. Each of the second and third hair attachments 38, 40 may include a pull tab 46 extending from the strip 30 so that a user may easily remove the attachments 38, 40 from the base mat 10.

The present invention may further include a fourth attachment 44. The fourth attachment 44 includes a connector, such as the other Velcro® fastener, that releasable connects with the Velcro® fastener 12 of the base mat 10. The fourth attachment 44 includes a netted pocket. The netted pocket is a plurality of crisscrossing fibers, forming space therebetween. A curved oblong object 48 may be placed within the netted pocket. An advanced user may attach the fourth attachment 44 to the connector of the base mat 10. A rounded or oval shaped object 48 is placed inside the netted pocket. The advanced user may attach real or fake hair strands to the netted pocket and begin braiding the hair along the rounded or oval shaped object 48. The curved oblong object 48 replicates the curvature of the human head.

A method of using the present invention may include the following. The present invention includes a technique for teaching the basics of how to cornrow by pairing the unique identifiers 20 on strands 24 to hair attachment 32 using alternating beads from strands 38 to elongate the individual braid into a cornrow. The technique progresses to an intermediate step by removing the beads 34 and 36 from the strands 38. The strands 40 will be for an intermediate skilled user as there are no bead identifiers 34 and 36 however the unique identifiers 20 will remain in place as a guide to continue to remind the user of the next step in the cornrow process. As an advanced step, the strands 40 are untwisted and combed to blend and simulate human hair 40 in FIG. 9. The unique identifiers 20 can be used to remind the user of the next step, however the goal of each step is to develop user skill that will allow the user to cornrow without the need for any identifiers such as 20, 34, or 36.

Figure 12A:
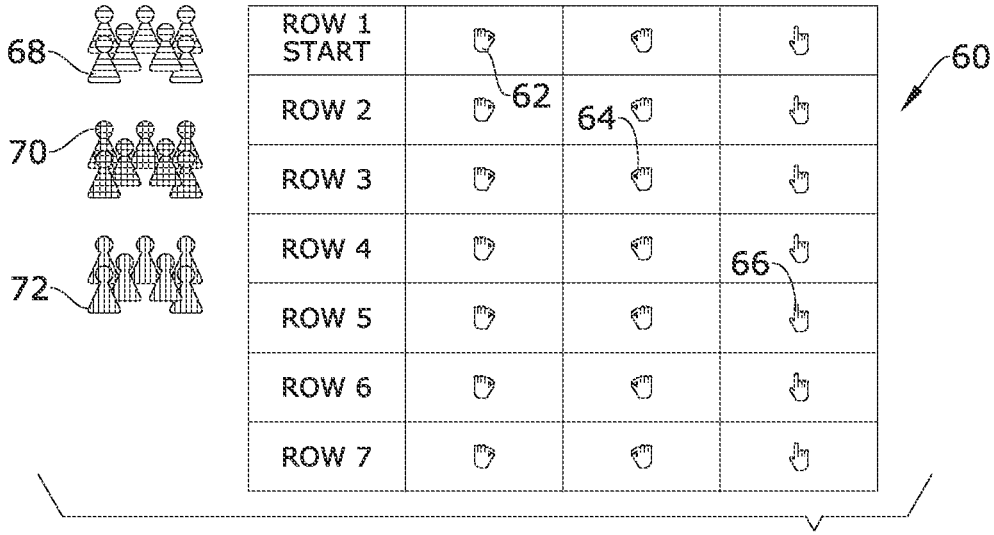
FIG. 12A is a schematic view of a game according to another embodiment of the present invention, illustrating initial setup.
Figure 12B:
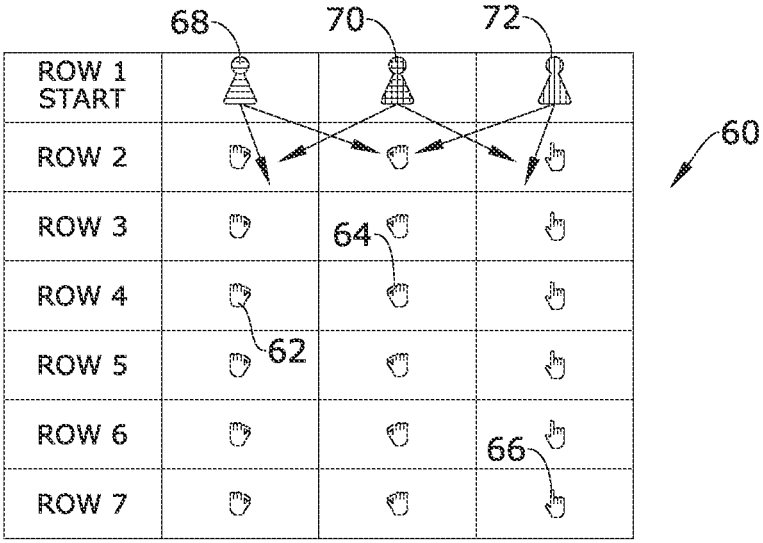
FIG. 12B is a schematic view thereof, illustrating moves available for each piece.
Figure 12C:
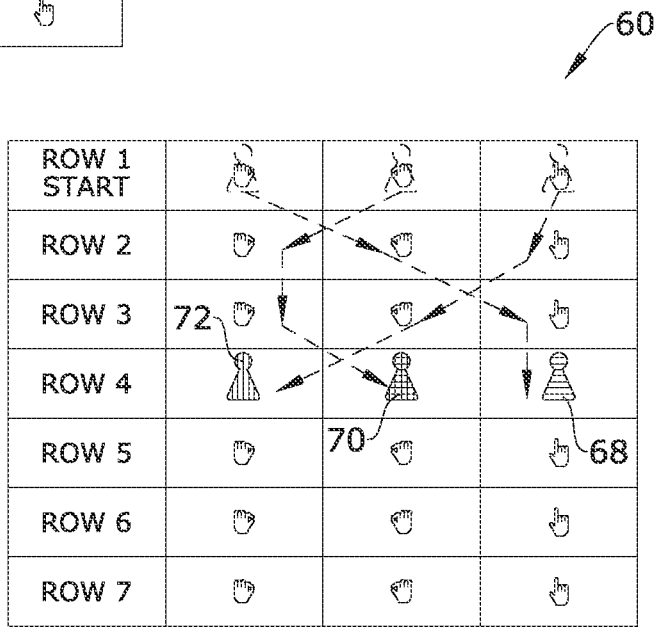
FIG. 12C is a schematic view thereof partway through play, showing the previous movement of the pieces.

FIGS. 12A, 12B, and 12C illustrate use of a game according to an embodiment of the present invention. The game board 60 of FIG. 12A exhibits a grid with 7 rows and 4 "lanes", one of which contains row numbers. Each cell within a lane of the grid has a hand icon 62, 64, 66 illustrating a finger placement for the respective step of braiding. As shown in FIG. 12B, different colored pawns or game pieces 68, 70, 72 may be placed in the top row of cells to start game play. The game pieces 68, 70, 72 may move downward diagonally or, if they are in the first or third column (e.g., 68, 72) may move one cell straight down, as game play proceeds. FIG. 12C illustrates that a pattern representative of a braid results. The final row of the grid ends with game pieces 68, 70, 72 in the same order as in the first (start) row. FIG. 12D illustrates an advanced grid which is an expansion of the grid in 12A. The expansion teaches a student developing their plaiting skill to incorporate the steps for integrating additional strands into a braid.

Figure 13:
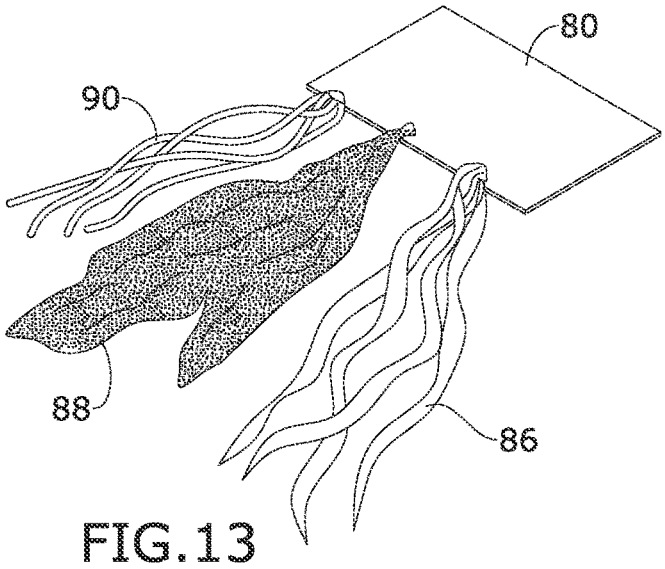
FIG. 13 is a top perspective view of a sticker platform according to another embodiment of the present invention.
Figure 14:
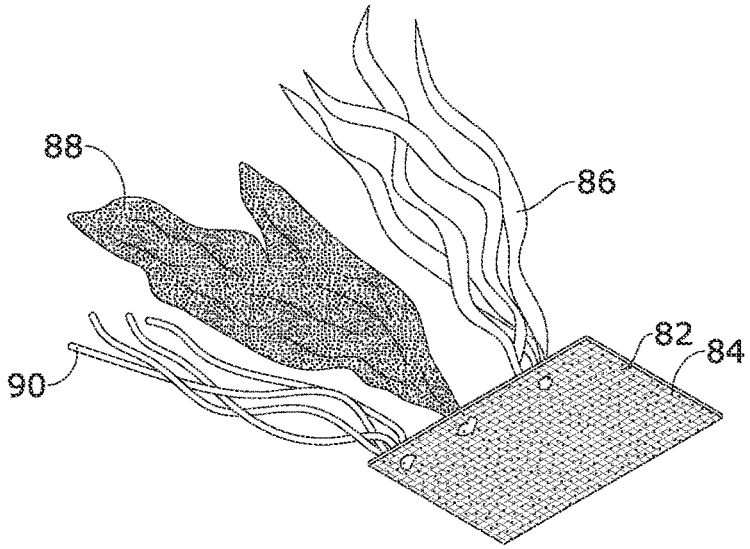
FIG. 14 is a bottom perspective view thereof.
Figure 15:
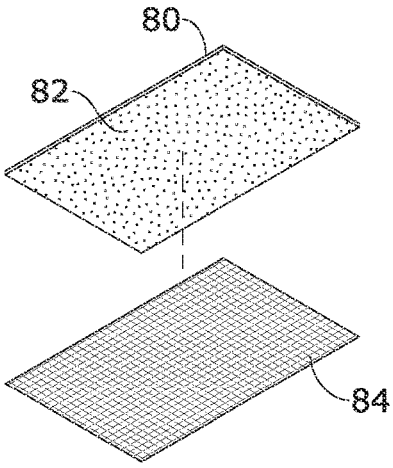
FIG. 15 is an exploded view of a net and sticker thereof.

FIGS. 13, 14, and 15 illustrate a braiding platform for practicing plaiting according to an embodiment of the present invention having different textures of sample hair 86, 88, 90 threaded and looped through a net backing 84. The net backing 84 is concealed with a sticker 80 having adhesive 82.

Figure 16:
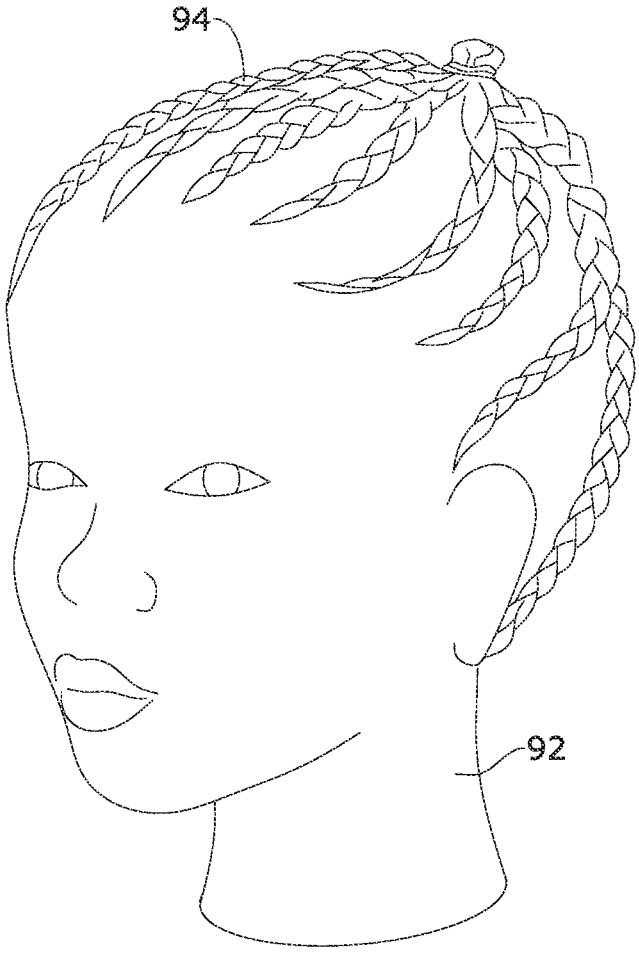
FIG. 16 is a perspective view of a mannequin head according to another embodiment of the present invention.

FIG. 16 shows a practice mannequin head 92 in a pre-plucked hairstyle to teach parting and braiding practice hair 94. The pre-parted sections, braid frequency, braid size, and braiding direction on the mannequin may vary to make learning easier or more challenging.

Figure 17:
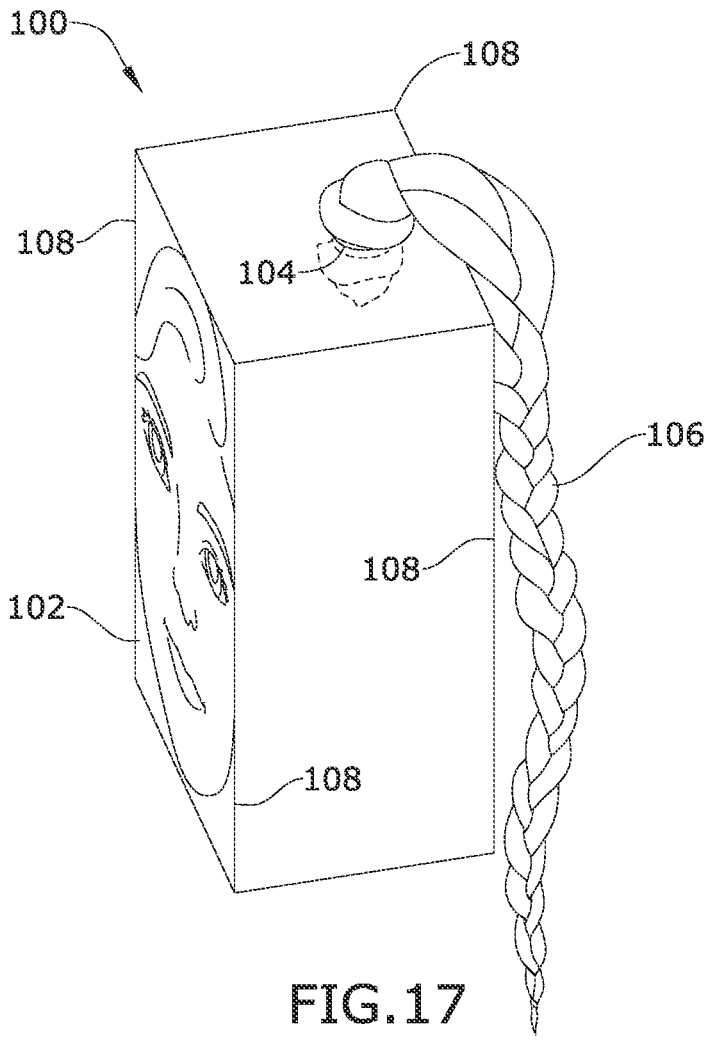
FIG. 17 is a perspective view of a braiding practice apparatus according to another embodiment of the present invention.
Figure 18:
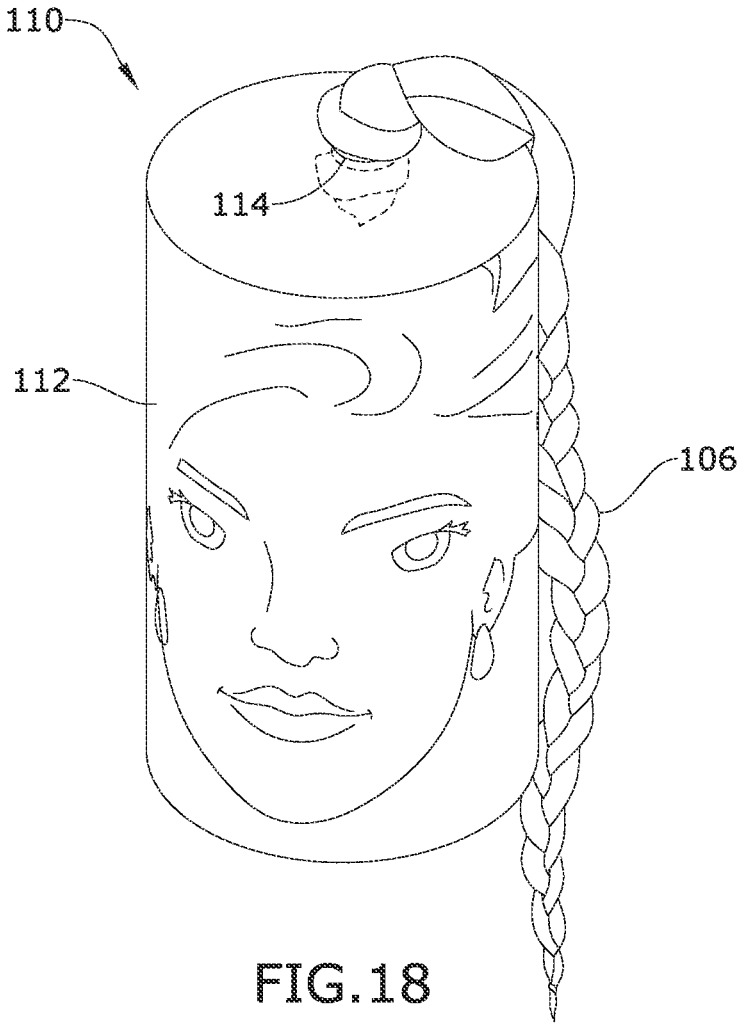
FIG. 18 is a perspective view of a braiding practice apparatus according to another embodiment of the present invention.

FIG. 17 and FIG. 18 illustrate embodiments of a braiding practice apparatus according to the present invention. The apparatus of FIG. 17 comprises a box assembly 100 having a vertical printed surface 102 illustrating a face and an attachment slot 104 on a top surface thereof through which a multistrand hair component 106 extends as a unified bundle. The edges 108 of the box assembly 100 can be used as guides, indicating the length of the braid. One or more of the edges 108 may in some cases be marked to serve as a ruler. The apparatus of FIG. 18 comprises a tube assembly 110 with a printed sidewall 112 illustrating a face and an attachment slot 114 on its top surface through which a multistrand hair extension tress 106 extends. The multistrand hair extension tress 106 may be used as a braiding training tool. When not in use, the multistrand hair component 106 may be removed from the attachment slot 104, 114 and stored inside (not shown) the box assembly 100 or the tube assembly 110.

It should be understood, of course, that the foregoing relates to exemplary embodiments of the invention and that modifications may be made without departing from the spirit and scope of the invention as set forth in the following claims.

What is claimed is:

1. A braid training tool, comprising:

a head component configured as a container having a top surface with an attachment slot formed therein;

a plurality of strands extending from the attachment slot as a unified bundle; wherein the plurality of strands is selected from the group consisting of: human hair, synthetic hair, yarn, and any combination thereof.

2. The braid training tool of claim 1, wherein the plurality of strands is configured to be formed into more than one braid selected from the group consisting of a cornrow, a plait, and combinations thereof.

3. The braid training tool of claim 1, wherein the head component further comprises a vertical surface having a face formed thereon.

4. The braid training tool of claim 1, wherein the head component is a container having a geometric shape selected from the group consisting of a cuboid, a cylinder, a cone, and a pyramid.

5. The braid training tool of claim 4, wherein the container has at least one edge operative as a ruler.

6. The braid training tool of claim 4, wherein the plurality of strands has a first length operative to form a braid having a second length greater than a height of the container.

7. The braid training tool of claim 1, wherein the plurality of strands is partitioned into one or more sectors.

8. The braid training tool of claim 7, wherein the one or more sectors includes at least two sectors, wherein the plurality of strands in each of the at least two sectors has a distinct thickness and/or texture.

9. The braid training tool of claim 8, wherein the at least two sectors are quadrants.

10. The braid training tool of claim 8, wherein the head component is configured as a mannequin head.

11. A method of strengthening dexterity, comprising:

providing the braid training tool of claim 7;

separating the plurality of strands in at least one of the one or more sectors into a predetermined number of sections;

interweaving the predetermined number of sections according to a predetermined pattern to form a braid having a selected length; and securing the braid.

12. The braid training tool of claim 1, wherein the plurality of strands is removable from the attachment slot and storable inside the container.

13. The braid training tool of claim 1, wherein the top surface is substantially flat.

* * * * *